US006899227B2

(12) United States Patent
Mierisch

(10) Patent No.: US 6,899,227 B2
(45) Date of Patent: May 31, 2005

(54) BOTTLE-SHIPPING BOX

(75) Inventor: Katja Mierisch, Wiehl (DE)

(73) Assignee: Sarstedt AG & Co., Numbrecht (DE)

( * ) Notice: Subject to any disclaimer, the term of this patent is extended or adjusted under 35 U.S.C. 154(b) by 16 days.

(21) Appl. No.: 10/717,431

(22) Filed: Nov. 18, 2003

(65) Prior Publication Data

US 2004/0144674 A1 Jul. 29, 2004

(30) Foreign Application Priority Data

Nov. 20, 2002 (EP) ..... 02025929

(51) Int. Cl.[7] ..... B65D 85/20
(52) U.S. Cl. ..... 206/446; 206/477; 206/592
(58) Field of Search ..... 206/438, 443, 206/446, 477, 480–483, 521, 591–594, 418–421, 433, 528, 784

(56) References Cited

U.S. PATENT DOCUMENTS 1,985,075 A * 12/1934 Bird ..... 206/418
3,095,086 A * 6/1963 Berg ..... 206/446
4,394,905 A * 7/1983 Hackenberg ..... 206/446
5,799,790 A * 9/1998 Ziegert et al. ..... 206/443

* cited by examiner

*Primary Examiner*—Luan K. Bui
(74) *Attorney, Agent, or Firm*—Herbert Dubno; Andrew Wilford

(57) ABSTRACT

A box for shipping bottles has a rectangular floor, generally parallel sides projecting from longitudinal edges of the floor, parallel ends projecting from end edges of the floor and bridging the sides, and a cover fittable over the sides and ends and forming therewith and with the floor a generally closed space. Holders set in a row are each hinged on the floor in the space and are each shiftable transversely toward and away from each of the sides to define bottle-holding spaces with the ends. The holders are of generally identical section but of different longitudinal length. Each holder has a pair of parallel legs having lower edges hinged on the floor and upper edges and a top panel bridging the respective upper edges and hinged thereon. One leg of each pair of legs is substantially shorter than the other leg to impart to the holders a right-trapezoidal shape.

7 Claims, 1 Drawing Sheet

BOTTLE-SHIPPING BOX

FIELD OF THE INVENTION

The present invention relates to a box for shipping one or more bottles. More particularly this invention concerns a shipping box for blood specimens in centrifuge tubes.

BACKGROUND OF THE INVENTION

A doctor typically draws sends drawn blood in standard centrifuge tubes to the laboratory that does the actual analysis. Such tubes are small cylindrical bottles made of glass or plastic and provided with a tight removable cover. As a rule they are simply put in a standard cardboard shipping box and surrounded with some sort of packing. In order to accommodate tubes of different sizes, as certain tests require a larger volume of blood than others but the laboratory normally only supplies a single type of shipping box, it is standard to pack with standard plastic peanuts, as in this manner any space around the bottle(s) can be filled.

Such a system has several disadvantages. First of all, if only a single tube is being shipped, there might not be enough packing material to hold it in place, so that the tube will be able to work its way into a position where it can be damaged or where it can bump against another tube. If several tubes are being sent, the user must discard the extra packing. At the laboratory end, digging out the tubes is inconvenient and, in some instances, a tube is so buried in the packing material that it is missed.

OBJECTS OF THE INVENTION

It is therefore an object of the present invention to provide an improved shipping box for small bottles.

Another object is the provision of such an improved shipping box for small bottles which overcomes the above-given disadvantages, that is which can securely hold one or more small bottles without the inconveniences detailed above.

SUMMARY OF THE INVENTION

A box for shipping bottles has according to the invention a generally rectangular floor, generally parallel sides projecting from longitudinal edges of the floor, generally parallel ends projecting from end edges of the floor and bridging the sides, and a cover fittable over the sides and ends and forming therewith and with the floor a generally closed space. Holders set in a longitudinal row are each hinged on the floor in the space and are each shiftable transversely toward and away from each of the sides to define bottle-holding spaces with the ends.

Thus with this system the holders can be shifted to the sides to define bottle-holding spaces in which the bottles fit snugly. For a short bottle, one of the holders relatively close to an end wall is shifted over; for a long bottle, a holder at a greater spacing from the end wall is shifted over. The holders are hinged in the box so that they cannot get lost and can, in fact, be repositioned when the box is reused for bottles of different lengths.

The holders according to the invention are of generally identical section but of different longitudinal length. In addition each holder has a pair of generally parallel legs having lower edges hinged on the floor and upper edges and a top panel bridging the respective upper edges and hinged thereon. The legs and top panel is stiff. Furthermore, one leg of each pair of legs is substantially shorter than the other leg so that the holders are of generally right-trapezoidal shape.

The lower edges of the legs are spaced transversely inward by a maximum bottle diameter from the respective sides. The holders are displaceable between center positions defining a pair of seats each extending along a respective one of the sides between the ends and end positions projecting into and longitudinally blocking the seats. Furthermore, each of the holders is displaceable into an intermediate position between the respective end position and center position and extending only partially into one of the seats so that in the intermediate position a holder can hold a small-diameter bottle down in the one seat.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
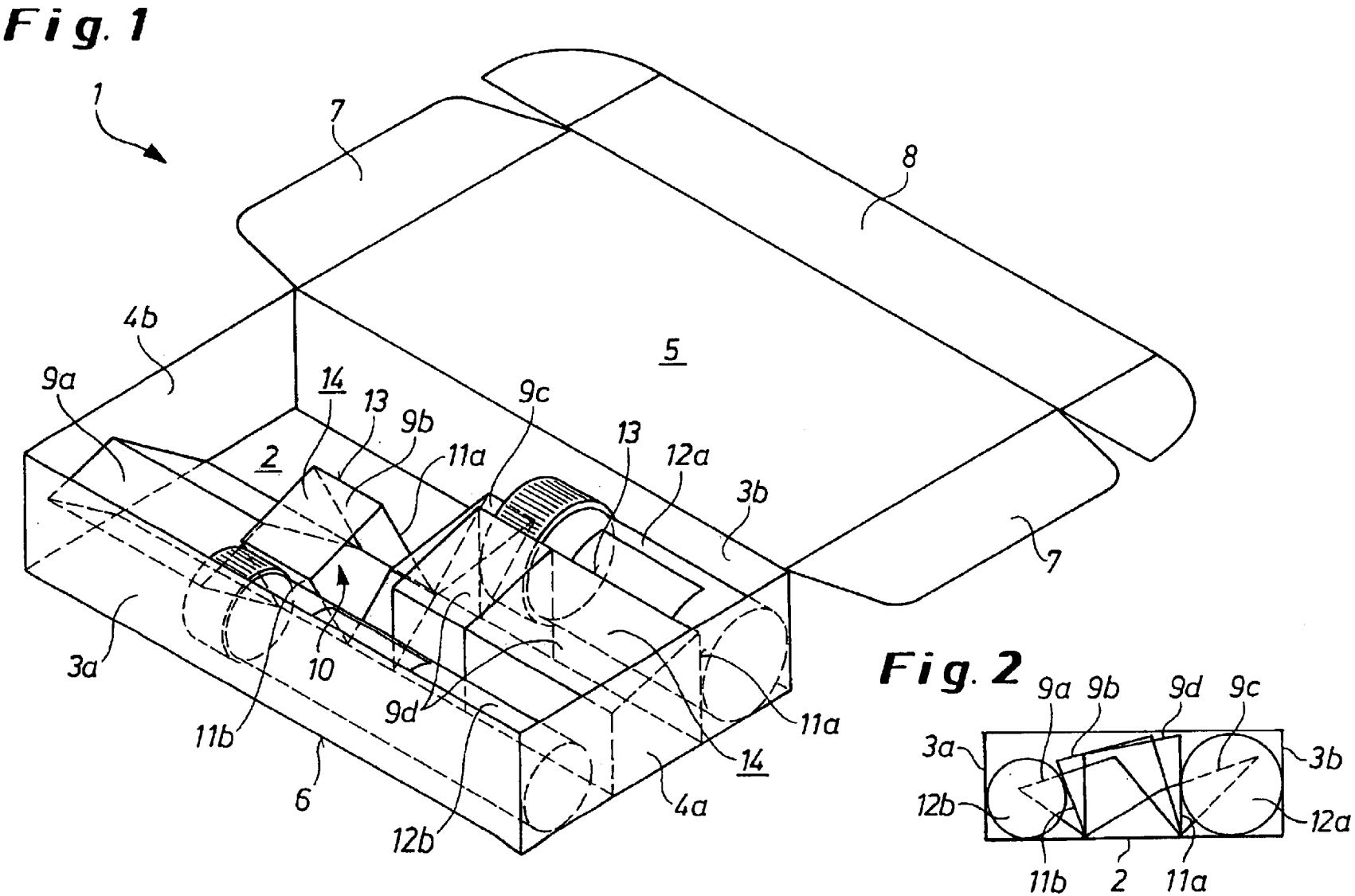
FIG. 1 is a partly diagrammatic and perspective view of the box according to the invention.
FIG. 2 is a schematic cross section through the box.

As seen in FIG. 1 a box 1 according to the invention is basically rectangularly parallelepipedal and has a planar floor panel 2, two long and parallel side panels or walls 3*a* and 3*b* extending perpendicular to the floor 2, two short and parallel end panels or walls 4*a* and 4*b* bridging the side panels 3*a* and 3*b* and perpendicular to the floor 2, and a cover panel 5 having end flaps 7 and a side flap 8. The cover panel 5 is hinged at an upper edge of the side panel 3*b*. Together the floor 2, sides 3*a* and 3*b*, ends 4*a* and 4*b*, and cover 5 define an interior 10.

According to the invention a plurality of holders 9*a*, 9*b*, 9*c*, and 9*d* are provided extending in a row down the middle of the interior 10 parallel to the side walls 3*a* and 3*b*. As schematically shown in FIG. 2, each of the holders 9*a*–9*d* is of right-trapezoidal section, having a pair of parallel leg panels 11*a* and 11*b*, the former longer than the latter, whose lower edges are hinged on the floor 2 or on a panel set thereon and whose upper edges are bridged by a top panel 14 that is connected at hinge corners 13 to the upper edges of these legs 11*a* and 11*b*. The holder 9*a*–9*d* do not have end walls so that they can be tipped toward the sides 3*a* and 3*b*, that is they are longitudinally open.

The box 1 is intended to hold a plurality of centrifuge tubes or similar bottles in seats 15*a* and 15*b* extending along the walls 3*b* and 3*a* the full length of the box 1 to opposite sides of the row of holders 9*a*–9*d*. Here a short and large-diameter tube 12*a* is shown as well as a longer small-diameter tube 12*b*, the former in the seat 15*a* against the wall 3*b* and the latter in the seat 15*b* against the wall 3*a*.

To hold the tube 12*a* in place, the holder 9*c* is tipped toward the panel 3*b* so that the tube 12*a* is captured longitudinally in the seat 15*a* between this holder 9*c* and the end wall 4*a*. The tube 12*b* is held in place by tipping the holder 9*a* toward the wall 3*a* so that it is captured longitudinally in the seat 15*b* between this holder 9*a* and the end wall 4*a*, and the holder 9*b* is also tipped toward the wall 3*a*, but not so far as the holder 9*a*, so as to come to rest on the side of the smaller-diameter tube 12*b* and hold it down in place against the floor 2. When the cover 5 is closed with the flaps 7 and 8 either tucked in or taped down, the hinge region 13 of the partially shifted holder 9*b* is pressed down by the cover 5 to hold it in place and hold down the tube 12*b*.

This box 1 can be reused many times. The holders 9*a*–9*d* can be shifted back and forth to accommodate standard-size bottles of many different sizes. These holders 9*a*–9*d* can be integrally formed with the floor 2 or with a panel that sits on the floor, as an insert, and will remain attached and workable over many uses.

I claim:

1. A box for shipping bottles, the box comprising:

a generally rectangular floor;

generally parallel sides projecting from longitudinal edges of the floor;

generally parallel ends projecting from end edges of the floor and bridging the sides;

a cover fittable over the sides and ends and forming therewith and with the floor a generally closed space;

a longitudinal row of holders hinged on the floor in the space and each shiftable transversely toward and away from each of the sides to define bottle-holding spaces with the ends.

2. The bottle-shipping box defined in claim 1 wherein the holders are of generally identical section but of different longitudinal length.

3. The bottle-shipping box defined in claim 1 wherein the holders each have a pair of generally parallel legs having lower edges hinged on the floor and upper edges and a top panel bridging the respective upper edges and hinged thereon, the legs and top panel being stiff.

4. The bottle-shipping box defined in claim 3 wherein one leg of each pair of legs is substantially shorter than the other leg, the holders being of generally right-trapezoidal shape.

5. The bottle-shipping box defined in claim 3 wherein the lower edges of the legs are spaced transversely inward by a maximum bottle diameter from the respective sides.

6. The bottle-shipping box defined in claim 3 wherein of the holders are displaceable between center positions defining a pair of seats each extending along a respective one of the sides between the ends and end positions projecting into and longitudinally blocking the seats.

7. The bottle-shipping box defined in claim 6 wherein each of the holders is displaceable into an intermediate position between the respective end position and center position and extending only partially into one of the seats, whereby in the intermediate position a holder can hold a small-diameter bottle down in the one seat.

* * * * *